US010890405B1

(12) United States Patent
Yoon

(10) Patent No.: US 10,890,405 B1
(45) Date of Patent: Jan. 12, 2021

(54) NON-TILTING OUTER BARREL FOR TOY GUN

(71) Applicant: Sang su Yoon, Seoul (KR)

(72) Inventor: Sang su Yoon, Seoul (KR)

( * ) Notice: Subject to any disclaimer, the term of this patent is extended or adjusted under 35 U.S.C. 154(b) by 0 days.

(21) Appl. No.: 16/458,407

(22) Filed: Jul. 1, 2019

(51) Int. Cl.
*F41A 21/48* (2006.01)
*F41A 21/32* (2006.01)

(52) U.S. Cl.
CPC ..... *F41A 21/485* (2013.01); *F41A 21/325* (2013.01)

(58) Field of Classification Search
CPC .. F41A 5/12; F41A 21/04; F41A 21/10; F41A 21/12; F41A 21/325; F41A 21/485; F41C 3/005; F41C 3/06
USPC ..... 42/54, 55, 75.01; 89/14.7; 124/83, 85
See application file for complete search history.

(56) References Cited

U.S. PATENT DOCUMENTS 808,680 A * 1/1906 Polley ..... F41A 9/64 124/85
842,324 A * 1/1907 Markham ..... F41A 9/64 124/85
3,273,460 A * 9/1966 Mason ..... F41A 5/24 89/185
3,359,856 A * 12/1967 Zehfeld ..... B60T 17/08 89/16
4,707,942 A * 11/1987 Peters ..... F41A 21/487 42/77
4,735,009 A * 4/1988 Jett, Jr. ..... F41A 21/10 102/446
5,649,520 A * 7/1997 Bednar ..... F41B 5/12 124/25
5,655,510 A * 8/1997 Kunimoto ..... F41B 11/00 124/81
5,808,229 A * 9/1998 Bastian ..... F41A 11/02 89/128
6,273,080 B1 * 8/2001 Sullivan, Jr. ..... F41B 11/00 124/73
6,357,331 B1 * 3/2002 Dionne ..... F41A 11/02 42/77
6,494,195 B2 * 12/2002 Perry ..... F41A 21/04 124/73
6,668,815 B1 * 12/2003 Fernandez ..... F41A 11/00 124/83
6,698,128 B2 * 3/2004 Kessler ..... F41A 21/00 124/83
7,603,998 B2 * 10/2009 Finstad ..... F41B 11/00 124/73
7,628,149 B1 * 12/2009 Zarecky ..... F41A 21/04 124/58
8,011,355 B2 * 9/2011 Kawashima ..... F41B 11/55 124/57
8,453,634 B2 * 6/2013 Chen ..... F41A 21/32 124/83

(Continued)

*Primary Examiner* — Stephen Johnson
*Assistant Examiner* — Benjamin S Gomberg
(74) *Attorney, Agent, or Firm* — Dinsmore & Shohl LLP; Yongsok Choi, Esq.

(57) ABSTRACT

A non-tilting outer barrel for a toy gun may include a first housing configured to accommodate at least a portion of an inner barrel through which a bullet is discharged, a second housing configured to accommodate at least a portion of a chamber coupled to one end of the inner barrel, a plurality of fixing members disposed in a bore of the first housing thereby restricting vertical movement of the first housing in relation to the inner barrel.

13 Claims, 7 Drawing Sheets

(56) References Cited

U.S. PATENT DOCUMENTS

| | | | | |
|---|---|---|---|---|
| 8,739,447 | B2 * | 6/2014 | Merritt | F41G 11/004 362/110 |
| 9,541,346 | B1 * | 1/2017 | Huang | F42B 10/26 |
| 9,696,101 | B2 * | 7/2017 | Kada | F41A 3/56 |
| 9,823,040 | B1 * | 11/2017 | Hu | F41A 21/12 |
| 10,024,627 | B2 * | 7/2018 | Pendleton | F41C 9/04 |
| 10,247,509 | B1 * | 4/2019 | Sumners | F41B 11/723 |

* cited by examiner

NON-TILTING OUTER BARREL FOR TOY GUN

TECHNICAL FIELD

The present invention relates to an outer barrel for a toy gun, and more specifically, to a non-tilting outer barrel for a toy gun which is configured not to perform a tilting operation thereof.

BACKGROUND

A survival game is one kind of mock battle game wherein a toy gun is used. The survival game is a game in which game participants gain enjoyment through a mock battle similar to an actual battle while carrying a toy gun which continuously fires bullets and using a variety of military equipment. The survival game has been widely played by many Korean and foreign clubs.

Conventional toy guns are manufactured by imitating the structure of real guns. In this case, since a portion of the outer barrel near the cartridge case outlet is configured to vertically move when the upper slide moves backward, a tilting operation, in which a front part (a gunpoint part) of the outer barrel moves upward, is performed. In the case of real guns, since bullets have an elongated shape, an angle, at which the bullets accommodated in the magazine are moved into the chamber, is formed by the tilting operation. On the other hand, in the case of toy guns, bullets have a spherical shape, and the tilting operation is not necessarily needed to move the bullet accommodated in the magazine into the chamber. Thus, when muzzle devices are mounted on the muzzle of the toy gun, interference occurs between the upper slide and the outer barrel when the upper slide moves forward and backward due to the weight of the muzzle device thereby interfering with smooth operation of the upper slide.

SUMMARY

According to one aspect of the present invention, there is provided a non-tilting outer barrel for a toy gun, comprising: a first housing configured to accommodate at least a portion of an inner barrel through which a bullet is discharged, a second housing configured to accommodate at least a portion of a chamber coupled to one end of the inner barrel, wherein the second housing is further configured to be coupled to the first housing, and a plurality of fixing members disposed in a bore of the first housing thereby restricting vertical movement of the first housing in relation to the inner barrel. The vertical movement is perpendicular to a central axis of the bore of the first housing, and the second housing includes a fixing groove, in which a protrusion formed on the chamber is inserted, thereby restricting horizontal movement of the second housing in relation to the chamber. The horizontal movement is perpendicular to the vertical movement.

In one embodiment of the present invention, the plurality of fixing members are formed of elastic members.

In one embodiment of the present invention, the plurality of fixing members are 0-rings.

In one embodiment of the present invention, a plurality of annular concave portions, each configured to hold each of the plurality of fixing members, are formed in the bore of the first housing, outer circumferential surfaces of the plurality of fixing members are inserted into to the plurality of annular concave portions, and inner circumferential surfaces of the plurality of fixing members come into contact with the inner barrel.

In one embodiment of the present invention, a first screw thread is formed on an outer circumferential surface of a first portion of the first housing at which the first housing is coupled to the second housing, and a second screw thread, which is coupled with the first screw thread, is formed on an inner circumferential surface of a second portion of the second housing at which the second housing is coupled to the first housing.

In one embodiment of the present invention, a third screw thread for mounting a muzzle device is formed on an inner circumferential surface of a third portion of the first housing, and the first portion is disposed on one end of the first housing and the third portion is disposed on an opposite end of the first housing.

According to another aspect of the present invention, there is provided a non-tilting outer barrel for a toy gun, comprising: a first housing configured to accommodate at least a portion of an inner barrel through which a bullet is discharged, a second housing configured to accommodate at least a portion of a chamber coupled to one end of the inner barrel, wherein the second housing is further configured to be coupled to the first housing, and a fixing member disposed in a bore of the first housing configured to fix the first housing to the inner barrel. The second housing includes a height adjustment member configured to adjust the height of the second housing such that the second housing is supported by a middle frame of the toy gun thereby restricting vertical movement of the non-tilting outer barrel in relation to the inner barrel and the middle frame. The vertical movement is perpendicular to a central axis of the bore of the first housing.

In one embodiment of the present invention, the fixing member is formed of an elastic member.

In one embodiment of the present invention, the fixing member is an O-ring.

In one embodiment of the present invention, an annular concave portion configured to hold the fixing member is formed in the bore of the first housing, an outer circumferential surface of the fixing member is inserted into to the annular concave portion, and an inner circumferential surface of the fixing member come into contact with the inner barrel.

In one embodiment of the present invention, a first screw thread is formed on an outer circumferential surface of a first portion of the first housing at which the first housing is coupled to the second housing, and a second screw thread, which is coupled with the first screw thread, is formed on an inner circumferential surface of a second portion of the second housing at which the second housing is coupled to the first housing.

In one embodiment of the present invention, a third screw thread for mounting a muzzle device is formed on an inner circumferential surface of a third portion of the first housing, and the first portion is disposed on one end of the first housing and the third portion is disposed on an opposite end of the first housing.

In one embodiment of the present invention, the second housing includes a groove having a groove depth greater than a groove height, and the height adjustment member is configured to adjust the groove height in order to adjust the height of the second housing.

BRIEF DESCRIPTION OF THE DRAWINGS

Embodiments of the present invention will be described, by way of example only, and with reference to the following drawings.

DETAILED DESCRIPTION

Figure 1:
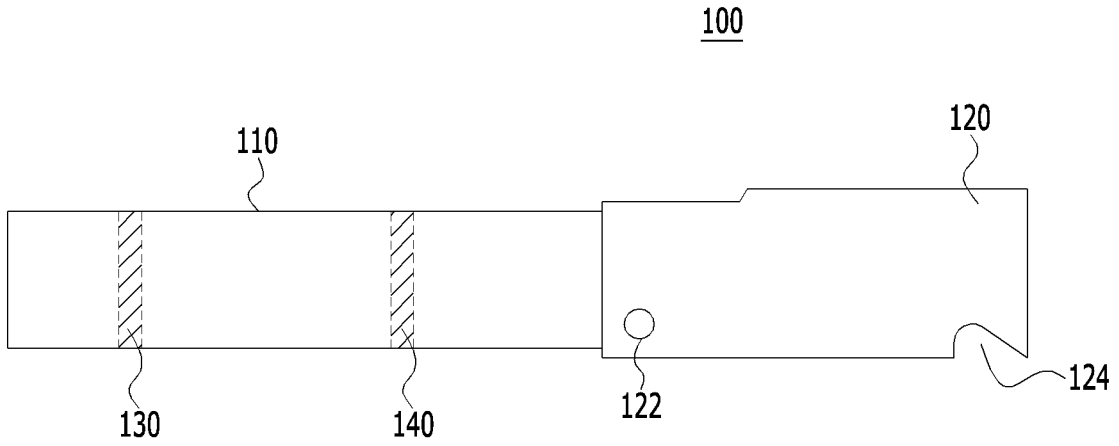
FIG. 1 shows a side view of a non-tilting outer barrel of a toy gun according to one embodiment of the present disclosure.

Some preferable embodiments will be described in more detail with reference to the accompanying drawings, in which the preferable embodiments of the present disclosure have been illustrated. However, the present disclosure can be implemented in various manners, and thus should not be construed to be limited to the embodiments disclosed herein. On the contrary, those embodiments are provided for the thorough and complete understanding of the present disclosure, and completely conveying the scope of the present disclosure to those skilled in the art.

It should be noted that in the drawings, like components or parts may be represented by like reference numerals, if possible. In describing the present disclosure, when a detailed description about a related well-known art may obscure the gist of the present disclosure, the detailed description thereof will not be provided.

In the accompanying drawings, like or relevant components may be indicated by like reference numerals. In the following description of the embodiments, repeated descriptions of the identical or relevant components may be omitted. However, even if a description of a component is omitted, such a component is not intended to be excluded in an embodiment. The relative terms such as the terms "upper portion" and "upper side" may be used to describe a relationship between components shown in the drawings, and the present disclosure is not limited to the terms.

Herein, the term "toy gun" may refer to airsoft guns that discharge plastic balls, paint balls, ball bearings, etc. Airsoft guns may be classified into spring-powered airsoft guns, battery-powered airsoft guns, gas-powered airsoft guns, etc., depending on how the devices are powered.

FIG. 1 shows a side view of a non-tilting outer barrel 100 of a toy gun according to one embodiment of the present disclosure. The outer barrel 100 may include a first housing 110, which accommodates at least a portion of an inner barrel through which a bullet is discharged, and a second housing 120 which accommodates at least a portion of a chamber coupled to one end of the inner barrel. The second housing 120 may be coupled to the first housing 110. For example, a screw thread may be formed at each of the first housing 110 and the second housing 120 such that the first housing 110 and the second housing 120 may be screw-coupled. In another embodiment, the first housing 110 and the second housing 120 may be integrally formed.

As shown, two fixing members 130 and 140 may be disposed in the first housing 110. In one embodiment, the fixing members 130 and 140 may be disposed in the bore of the first housing. The first housing 110 may be fixed to the inner barrel by the fixing members 130 and 140 such that vertical movement (upward and downward movements in the drawing) of the first housing in relation to the inner barrel may be restricted. The vertical movement may be perpendicular to a central axis of the bore of the first housing 110. Although two fixing members 130 and 140 have been described, the present invention is not limited thereto, and three or more fixing members may be used.

In one embodiment, the fixing members 130 and 140 may be elastic members. For example, the fixing members 130 and 140 may be O-rings. A plurality of annular concave portions for holding the fixing members 130 and 140 may be formed in a bore of the first housing 110. Outer circumferential surfaces of the fixing members 130 and 140 may be inserted into and fixed to the annular concave portions, and inner circumferential surfaces of the fixing members may come into contact with the inner barrel. The inner barrel may be inserted into the bores of the fixing members 130 and 140 such that the first housing 110 may be fixed to the inner barrel.

A fixing groove 124 may be formed on one side surface of the second housing 120 where a protrusion formed on the chamber is inserted. By inserting the protrusion formed on the chamber into the fixing groove 124, horizontal movement (leftward and rightward movements in the drawing; perpendicular to the vertical movement) of the second housing 120 in relation to the chamber and the inner barrel may be restricted. In one embodiment, a thread groove 122 may be formed on one side surface of the second housing 120. The thread groove 122 accommodates a screw such as a hex head cap screw and the like such that the first housing 110 and the second housing 120 may be fixed. The second housing 120 may also be fixed to the chamber by inserting the hex head cap screw into the thread groove.

As described above, it is possible to restrict vertical movement and horizontal movement of the non-tilting outer barrel 100 by arranging the fixing members 130 and 140 in the bore of the first housing 110, inserting the inner barrel into the fixing members 130 and 140, and inserting the protrusion of the chamber into the fixing groove 124 of the second housing 120. That is, the non-tilting outer barrel 100 is fixed to the inner barrel and the chamber such that a tilting operation is not performed. Accordingly, even when muzzle devices such as silencers, auto-tracers, compensators, and the like are mounted on a muzzle of a toy gun, it is possible to perform a smooth mechanical operation without interference between the outer barrel and an upper slide.

Figure 2:
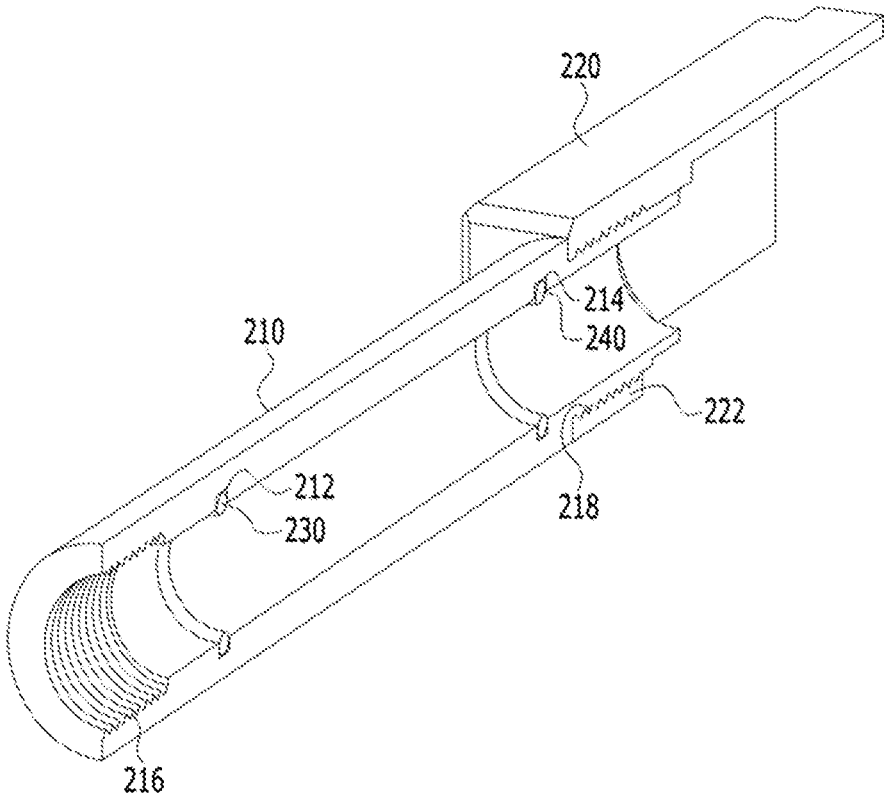
FIG. 2 shows a perspective cross-sectional view of a non-tilting outer barrel according to one embodiment of the present disclosure.

FIG. 2 shows a perspective cross-sectional view of a non-tilting outer barrel 200 according to one embodiment of the present disclosure. The non-tilting outer barrel 200 may include a first housing 210, which accommodates at least a portion of an inner barrel through which a bullet is discharged, and a second housing 220 which accommodates at least a portion of a chamber coupled to one end of the inner barrel. The second housing 220 may be coupled to the first housing 210. As shown in the drawing, a first screw thread 218 and a second screw thread 222 are formed on the first housing 210 and the second housing 220, respectively, such that the first housing 210 and the second housing 220 may be coupled using screws. That is, the first screw thread 218 configured to be coupled with the second housing 220 may be formed on an outer circumferential surface of one end of the first housing 210, and the second screw thread 222 configured to be coupled with the first screw thread 218 may be formed on an inner circumferential surface of one end of the second housing 220.

As shown, two annular concave portions 212 and 214 may be formed in a bore of the first housing 210. Fixing members 230 and 240 may be inserted into the annular concave portions 212 and 214, respectively, such that two fixing members 230 and 240 are disposed in the first housing 210. Specifically, outer circumferential surfaces of the fixing members 230 and 240 may be inserted into and fixed to the annular concave portions 212 and 214, and inner circumferential surfaces of the fixing members 230 and 240 may come into contact with the inner barrel. The inner barrel may be inserted into bores of the fixing members 230 and 240 such that the first housing 210 may be fixed to the inner barrel. That is, the first housing 210 may be fixed to the inner barrel by the fixing members 230 and 240 such that a vertical movement (upward and downward movements in the drawing) of the first housing may be restricted. Although the two fixing members 230 and 240 have been described, the present invention is not limited thereto, and three or more fixing members may be used.

In one embodiment, the fixing members 230 and 240 may be elastic members. For example, circular rings formed of synthetic rubber, heat-resistant plastic, etc. such as O-rings may be used as fixing members 230 and 240. However, the present embodiment is not limited thereto, and a variety of parts capable of being inserted into the annular concave portions 212 and 214 and fixing the first housing 210 to the inner barrel may be used.

In one embodiment, a third screw thread 216 for mounting a muzzle device such as a silencer, an auto-tracer, a compensator, and the like may be formed on an inner circumferential surface of the other end of the first housing 210. For example, an adapter may be mounted on the third screw thread 216, and an 11 mm or 14 mm muzzle device (for example, a silencer, an auto-tracer, or a compensator) may be mounted through the adapter. In another embodiment, the third screw thread 216 for mounting a muzzle device may be formed on an outer circumferential surface of the other end of the first housing 210.

Figure 3:
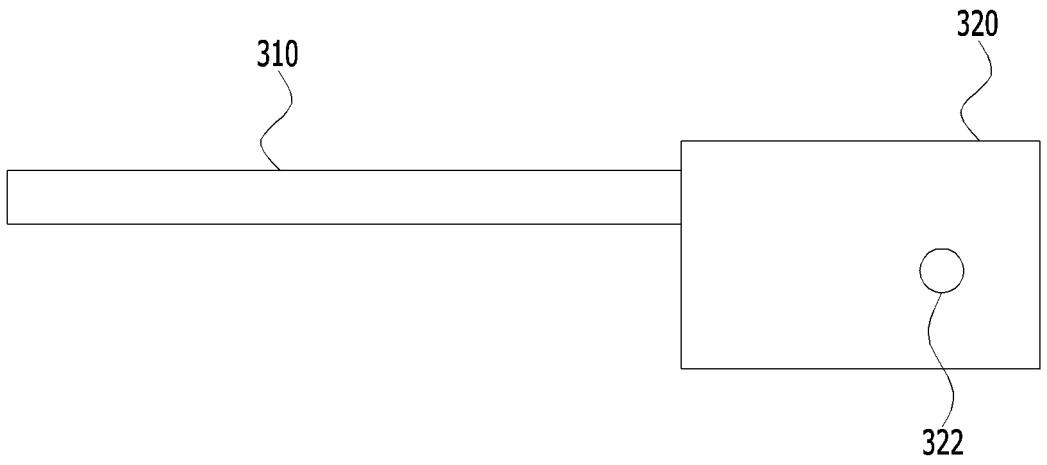
FIG. 3 shows a side view illustrating an inner barrel and a chamber according to one embodiment of the present disclosure.

FIG. 3 shows a side view illustrating an inner barrel 310 and a chamber 320 according to one embodiment of the present disclosure. The inner barrel 310 and the chamber 320 may be integrally formed or may be configured to be assembled or disassembled. The protrusion 322 protruding in a convex cylinder shape may be formed on one side surface of the chamber 320. Although the protrusion 322 has been shown as a circular cylinder shape, is not limited thereto, and may be formed to have a variety of shapes and forms.

Figure 4:
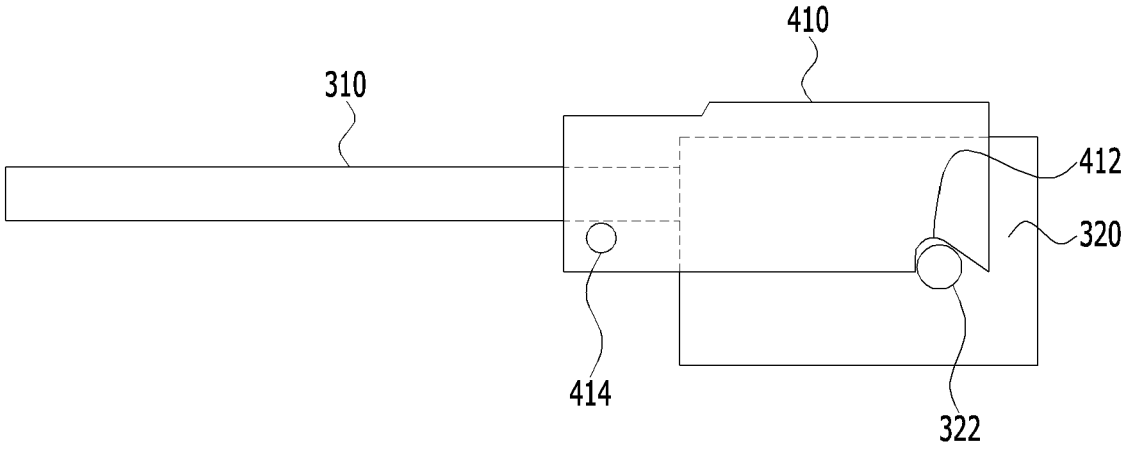
FIG. 4 shows a side view illustrating a state in which a second housing is coupled with the inner barrel and the chamber according to one embodiment of the present disclosure.

FIG. 4 shows a side view illustrating a state in which a second housing 410 is coupled with the inner barrel 310 and the chamber 320 according to one embodiment of the present disclosure. An opening portion, into which the inner barrel 310 is inserted, may be formed on one end of the second housing 410. In addition, a fixing groove 412, in which the protrusion 322 of the chamber 320 may be inserted into, and a thread groove 414 may be formed on one side surface of the second housing 410. The inner barrel 310 may be inserted into the opening portion of the second housing 410 and the protrusion 322 of the chamber 320 may be inserted into the fixing groove 412 of the second housing 410 such that the second housing 410 may be coupled with the inner barrel 310 and the chamber 320. As shown, the second housing 410 may accommodate at least a portion of the inner barrel 310 and at least a portion of the chamber 320.

Figure 5:
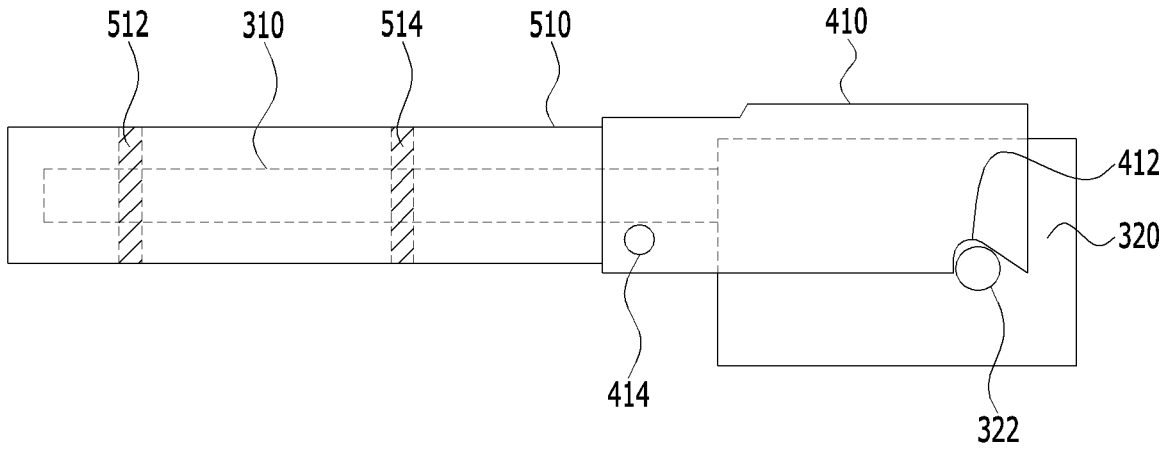
FIG. 5 shows a side view illustrating a state in which a first housing and the second housing are coupled with the inner barrel and the chamber according to one embodiment of the present disclosure.

FIG. 5 shows a side view illustrating a state in which a first housing 510 and a second housing 410 are coupled with the inner barrel 310 and the chamber 320 according to one embodiment of the present disclosure. In the state in which the second housing 410 is coupled with the inner barrel 310 and the chamber 320 (see FIG. 4), the inner barrel 310 may be inserted into the first housing 510 such that the first housing 510 accommodates at least a portion of the inner barrel 310. The first housing 510 may be combined with the second housing 410 using a screw thread and the like.

As shown, the first housing 510 may be fixed to the inner barrel 310 by two fixing members 512 and 514 disposed in the bore of the first housing 510. That is, vertical movement of the first housing 510 may be restricted by the fixing members 512 and 514. In one embodiment, after the first housing 510 and the second housing 410 are coupled with the inner barrel 310 and the chamber 320, a screw such as a hex head cap screw and the like may be inserted into the thread groove 414 to prevent the first housing 510 and the second housing 410 from being separated.

Although one thread groove 414 formed on a side surface of the second housing 410 has been shown in FIG. 5, it not limited thereto and two or more thread grooves may be formed. Also, instead of forming the thread groove 414 or in addition, the first housing 510 and the second housing 410 may be fixed using an adhesive (for example, Loctite). Although FIGS. 3 to 5 show that the second housing 410 and the first housing 510 are sequentially coupled with the inner barrel 310 and the chamber 320, the present invention is not limited thereto, and the first housing 510 and the second housing 410 may be coupled to each other first and then coupled to the inner barrel 310 and the chamber 320.

Figure 6:
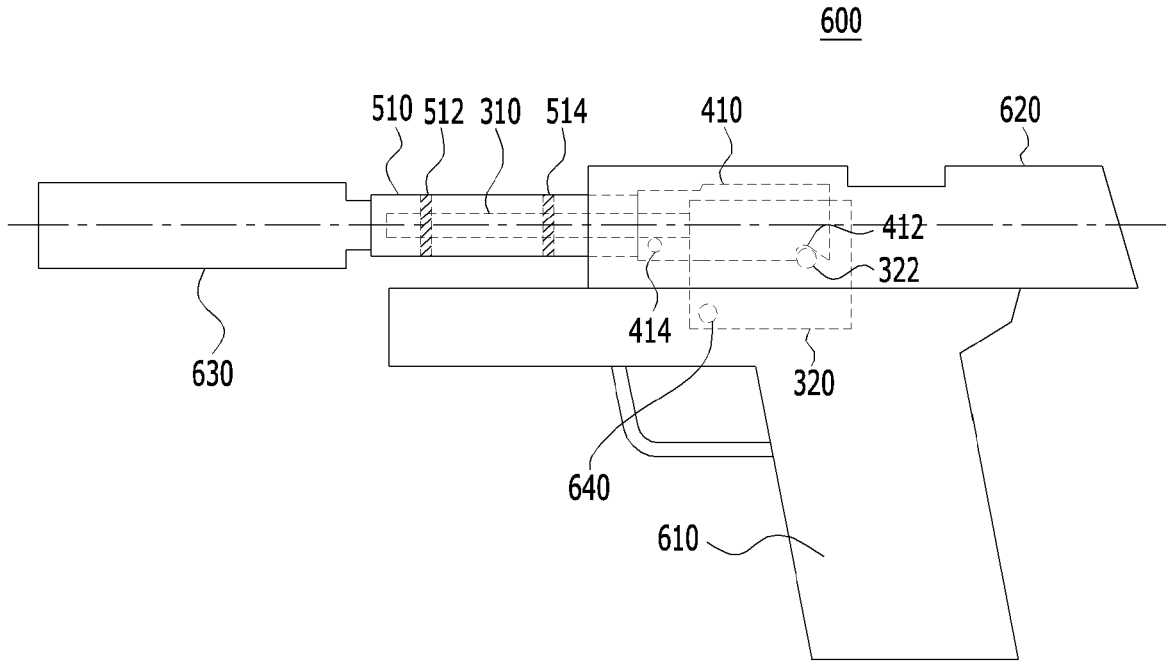
FIG. 6 shows a side view of a toy gun including a non-tilting outer barrel according to one embodiment of the present disclosure.

FIG. 6 shows a side view of a toy gun 600 including a non-tilting outer barrel according to one embodiment of the present disclosure. The inner barrel 310 and the chamber 320 shown in FIG. 5, on which the first housing 510 and the second housing 410 are mounted, may be installed on a toy gun lower frame 610. Herein, the chamber 320 may be coupled to the lower frame 610 via a support member 640.

Then, an upper slide 620 may be installed above the lower frame 610 to accommodate at least portions of the first housing 510 and the second housing 410. In another embodiment, the inner barrel 310 and the chamber 320 shown in FIG. 5, on which the first housing 510 and the second housing 410 are mounted, may be installed at the upper slide 620, and the upper slide 620 may be coupled with the lower frame 610.

In one embodiment, a middle frame (not shown), in which sliding groove(s) through which the upper slide 620 is slidable back and forth is formed, may be mounted on the lower frame 610. In this case, at least a portion of the chamber 320 may be disposed within the middle frame. The chamber 320 may be fixed to the middle frame. The upper slide 620 may be inserted along the sliding groove(s) of the middle frame. The height of the second housing 410 may be determined or adjusted by a distance between a top end of the middle frame and a top inner surface of the upper slide 620.

In one embodiment, a muzzle device 630 may be mounted on the muzzle (one end of the first housing) of the toy gun 600. In the present invention, as described above, it is possible to restrict vertical movement and horizontal movement of the non-tilting outer barrel (the first housing 510 and the second housing 410) by arranging the fixing members 512 and 514 in the bore of the first housing 510, inserting the inner barrel 310 into the fixing members 512 and 514, and inserting the protrusion 322 of the chamber into the fixing groove 412 of the second housing 410. That is, the non-tilting outer barrel (the first housing 510 and the second housing 410) is fixed to the inner barrel 310 and the chamber 320 such that a tilting operation is not performed.

Accordingly, even when the muzzle device 630 is mounted on the muzzle of the toy gun 600, the upper slide 620 may move smoothly without interference between the outer barrel and the upper slide 620. Also, since the tilting operation is not performed, the outer barrel (the first housing 510 and the second housing 410) and the gunpoint are aligned such that a bullet-focusing property is improved. As shown, the central axis of the bore of the first housing and the central axis of the inner barrel 310 may be in line with each other.

Figure 7:
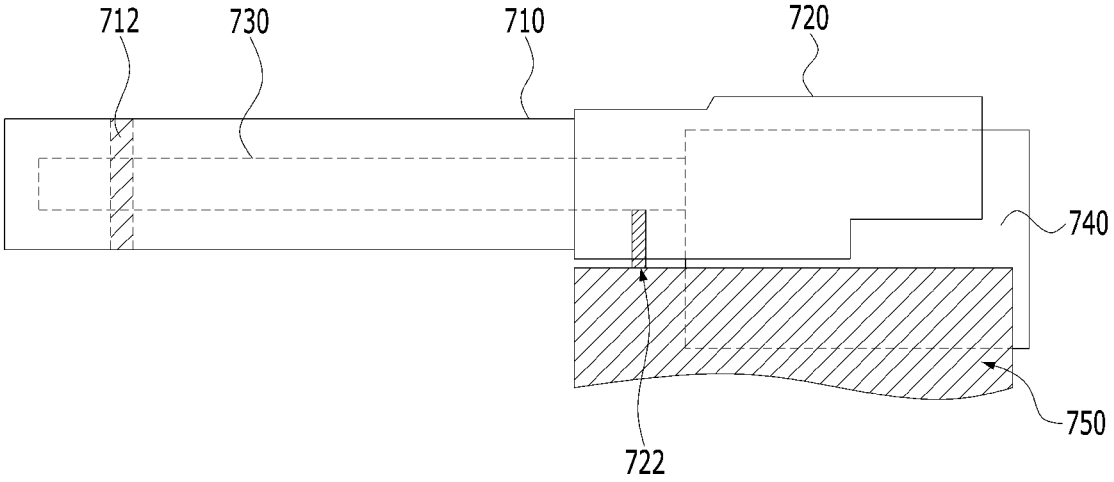
FIG. 7 shows a side view illustrating a height adjustable non-tilting outer barrel according to one embodiment of the present disclosure.

FIG. 7 shows a side view illustrating a height adjustable non-tilting outer barrel according to one embodiment of the present disclosure. As shown, the height adjustable non-tilting outer barrel may comprise a first housing 710 and a second housing 720. The first housing 710 and the second housing 720 may be coupled with an inner barrel 730 and a chamber 740.

The first housing 710 may include a single fixing member 712 disposed in the bore of the first housing. In one embodiment, the fixing member 712 may be an elastic member. For example, a circular ring formed of synthetic rubber, heat-resistant plastic, etc. such as an O-ring may be used as the fixing member 712. However, the present embodiment is not limited thereto, and a variety of parts capable of being inserted into an annular concave portion (not shown) formed in the bore of the first housing 710 for holding the fixing member 712 and fixing the first housing 710 to the inner barrel 730 may be used.

The second housing 720 may include a height adjustment member 722 configured to adjust the height of the second housing 720. The second housing 720 may accommodate at least a portion of the chamber 740 and the inner barrel 730 may be inserted into the first housing 710 such that the first housing 710 accommodates at least a portion of the inner barrel 730. The first housing 710 may be combined with the second housing 720 using a screw thread and the like. Alternatively, the first housing 710 and the second housing 720 may be integrally formed.

In one embodiment, at least a portion (e.g., lower portion) of the chamber 740 may be disposed within a middle frame 750. The chamber 740 may be fixed to the middle frame 750. The middle frame 750 may have a sliding groove(s) (not shown) through which an upper slide (not shown) is slidable back and forth.

In one embodiment, the height of the second housing 720 may be adjusted such that the gap between the second housing 720 and the middle frame 750 is eliminated. For example, the height of the second housing 720 may be adjusted by moving the height adjustment member 722 in a vertical direction (upward and downward direction in the drawing). By eliminating the gap between the second housing 720 and the middle frame 750, the second housing 720 may be supported by the middle frame 750 thereby restricting vertical movement (upward and downward movements in the drawing) of the second housing 720.

Vertical movement (upward and downward movements in the drawing) of the first housing 710 and the second housing 720 in relation to the inner barrel 730, the chamber 740, and the middle frame 750 may be restricted by the single fixing member 712 and the height adjustment member 722. That is, the non-tilting outer barrel (the first housing 710 and the second housing 720) may be fixed to the inner barrel 730 and supported by the middle frame 750 such that a tilting operation is not performed.

Figure 8:
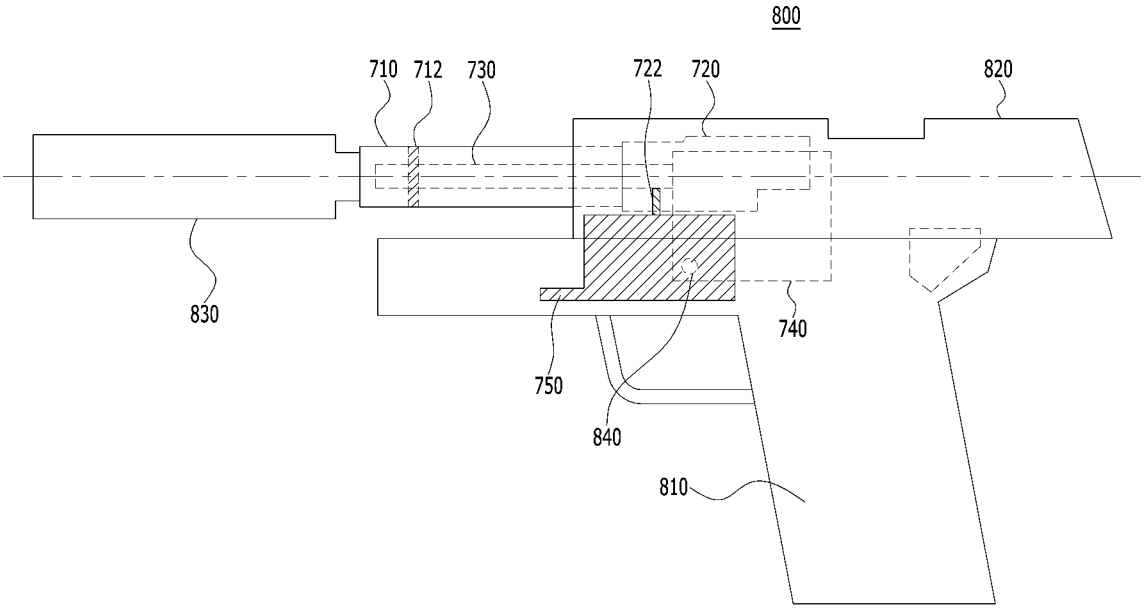
FIG. 8 shows a side view of a toy gun including a non-tilting outer barrel according to one embodiment of the present disclosure.

FIG. 8 shows a side view of a toy gun 800 including a non-tilting outer barrel according to one embodiment of the present disclosure. The middle frame 750 may be mounted on a lower frame 810 of the toy gun 800. The inner barrel 730 and the chamber 740 shown in FIG. 7, on which the first housing 10 and the second housing 720 are mounted, may be installed on the middle frame 750 and/or the lower frame 810. Herein, the chamber 320 may be coupled to the lower frame 610 and/or the lower frame 810 via a support member 840.

The upper slide 820 may be inserted along the sliding groove(s) (not shown) of the middle frame 750. The height of the second housing 720 may be adjusted by moving the height adjustment member 722 in a vertical direction (upward and downward direction in the drawing). For example, the height of the second housing 720 may be adjusted such that a gap between the second housing 720 and the middle frame 750 is eliminated.

In one embodiment, a muzzle device 830 may be mounted on the muzzle (one end of the first housing) of the toy gun 800. In the present invention, as described above, it is possible to restrict vertical movement of the non-tilting outer barrel (the first housing 710 and the second housing 720) by arranging the fixing member 712 in the bore of the first housing 710, inserting the inner barrel 730 into the fixing member 512, and eliminating the gap between the second housing 720 and the middle frame 750. That is, the non-tilting outer barrel (the first housing 710 and the second housing 720) may be fixed to the inner barrel 310 and disposed on the middle frame 750 such that a tilting operation is not performed.

Accordingly, even when the muzzle device 830 is mounted on the muzzle of the toy gun 800, the upper slide 820 may move smoothly without interference between the outer barrel and the upper slide 820. Also, since the tilting operation is not performed, the outer barrel (the first housing 710 and the second housing 720) and the gunpoint are aligned such that a bullet-focusing property is improved. As shown, the central axis of the bore of the first housing and the central axis of the inner barrel 710 may be in line with each other.

Figure 9:
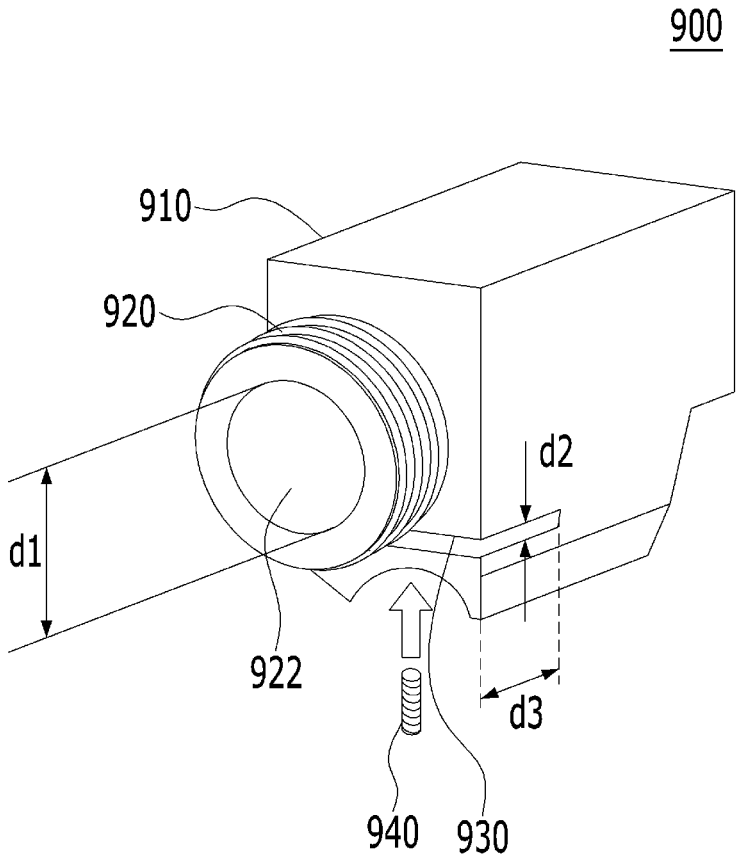
FIG. 9 shows a perspective view of a height adjustable second housing according to one embodiment of the present disclosure.

FIG. 9 shows a perspective view of a height adjustable second housing 900 according to one embodiment of the present disclosure. As shown, the second housing 900 may comprise a main body 910 and a screw thread 920. The screw thread 920 may be formed on one side of the main body 910. The screw thread 920 may be configured to be coupled to a corresponding screw thread formed on a first housing (not shown).

The main body 910 and the screw thread 920 may have a cylindrical shaped opening 922 where an inner barrel (not shown) may be inserted. The diameter (d1) of the opening 922 may be equal to or greater than the diameter of the inner barrel. Preferably, the diameter (d1) of the opening 922 may be equal to the diameter of the inner barrel such that the inner barrel is tightly supported by the opening 922.

The main body 910 may comprise a groove 930 having a groove width d2 and a groove depth d3. The groove depth d3 may be greater than the groove width d2 such that the groove width d2 may be easily adjustable. The groove 930 divides the main body 910 into an upper portion and a lower portion. The upper portion of the main body 910 may comprise the screw thread 920 and the opening 922.

The groove width d2 may be adjusted by inserting a height adjusting member 940 into a thread groove (not shown) formed in the lower portion of the main body 910 in a vertical direction as will be described in detail below. The height adjusting member 940 may be a screw such as a hex head cap screw and the like.

Figure 10:
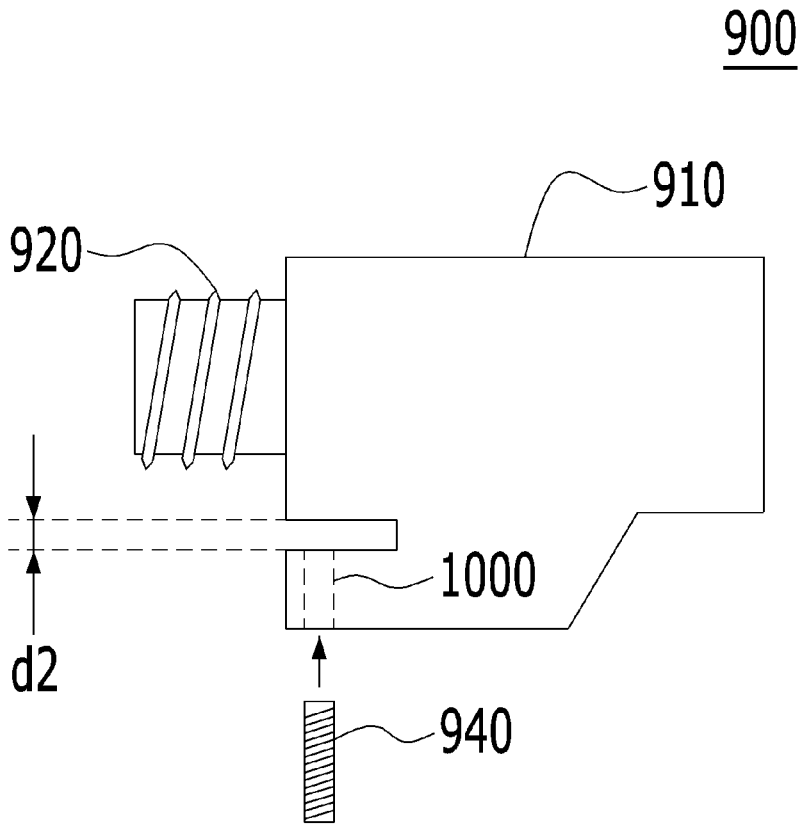
FIG. 10 shows a side view illustrating a state in which a height adjustable second housing has a groove width d2 according to one embodiment of the present disclosure.

FIG. 10 shows a side view illustrating a state in which a height adjustable second housing 900 has a groove width d2 according to one embodiment of the present disclosure. As shown, a thread groove 1000 may be formed in the lower portion of the main body 910. The height adjusting member 940 may be inserted into the thread groove 1000 to adjust the groove width thereby adjusting the height of the second housing 900.

Figure 11:
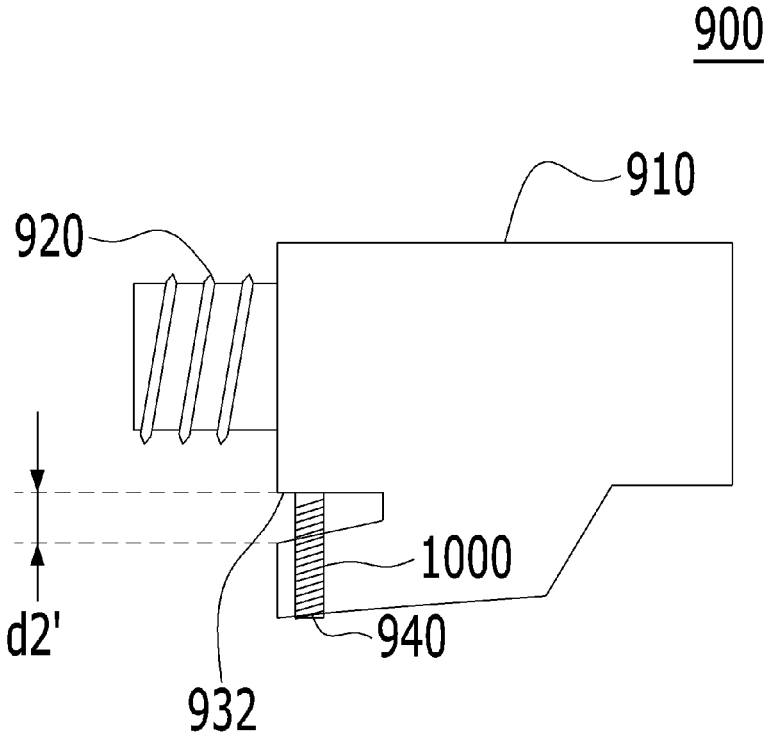
FIG. 11 shows a side view illustrating a state in which a height adjustable second housing has a groove width d2' according to one embodiment of the present disclosure.

FIG. 11 shows a side view illustrating a state in which a height adjustable second housing 900 has a groove width d2' according to one embodiment of the present disclosure. The height adjusting member 940 may be inserted into the thread groove 1000 and move in a vertical direction by rotating the height adjusting member 940 in a clockwise or counter-clockwise direction. Once one end of the height adjusting member 940 reaches a surface of the groove 932, the groove width may start to increase as the height adjusting member 940 continues to rotate.

As shown, the height adjusting member 940 may be rotated until the groove width is adjusted to a desired height, e.g., d2'. By adjusting the groove width, the height of the second housing may also be adjusted. In one embodiment, the groove width may be adjusted such that a gap between the second housing 900 and a middle frame (not shown) is eliminated. By eliminating the gap between the second housing 900 and the middle frame (not shown), the second housing 900 may be supported by the middle frame (not shown) thereby restricting vertical movement (upward and downward movements in the drawing) of the second housing 900.

In another embodiment, the thread groove 1000 may extend to the upper portion of the second housing 900. In such a case, one end of the height adjusting member 940 may be supported by the outer surface of the inner barrel which is inserted into the opening 922.

By using a height adjustable second housing, a single non-tilting outer barrel design may be used for different types of guns. In addition, variation in product size may also be compensated by adjusting the height of the non-tilting outer barrel.

Although the non-tilting outer barrel for a toy gun according to the present disclosure has been described above with reference to the illustrated drawings, the present disclosure is not limited to the embodiments and drawings disclosed in this specification but may be modified in various ways by those skilled in the art without departing from the technical spirit of the present disclosure.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplate are examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "comprising," "including," and "having" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A non-tilting outer barrel for a toy gun, comprising:

a first housing configured to accommodate at least a portion of an inner barrel through which a bullet is discharged;

a second housing configured to accommodate at least a portion of a chamber coupled to one end of the inner barrel, wherein the second housing is further configured to be coupled to the first housing; and a plurality of fixing members disposed in a bore of the first housing thereby restricting vertical movement of the first housing in relation to the inner barrel, wherein the vertical movement is perpendicular to a central axis of the bore of the first housing, wherein the second housing includes a fixing groove, in which a protrusion formed on the chamber is inserted, thereby restricting horizontal movement of the second housing in relation to the chamber, wherein the horizontal movement is perpendicular to the vertical movement, wherein the second housing further includes a thread groove formed on one side surface of the second housing, wherein the thread groove accommodates a screw such that the first housing and the second housing are fixed.

2. The non-tilting outer barrel of claim 1, wherein the plurality of fixing members are formed of elastic members.

3. The non-tilting outer barrel of claim 2, wherein the plurality of fixing members are O-rings.

4. The non-tilting outer barrel of claim 3, wherein a plurality of annular concave portions, each configured to hold one of the plurality of fixing members, are formed in the bore of the first housing, wherein outer circumferential surfaces of the plurality of fixing members are inserted into the plurality of annular concave portions, and wherein inner circumferential surfaces of the plurality of fixing members contact the inner barrel.

5. The non-tilting outer barrel of claim 1, wherein a first screw thread is formed on an outer circumferential surface of a first portion of the first housing at which the first housing is coupled to the second housing, and wherein a second screw thread, which is coupled with the first screw thread, is formed on an inner circumferential surface of a second portion of the second housing at which the second housing is coupled to the first housing.

6. The non-tilting outer barrel of claim 5, wherein a third screw thread for mounting a muzzle device is formed on an inner circumferential surface of a third portion of the first housing, and wherein the first portion is disposed on one end of the first housing and the third portion is disposed on an opposite end of the first housing.

7. The non-tilting outer barrel of claim 1, wherein the screw is a hex head cap screw.

8. A non-tilting outer barrel for a toy gun, comprising:

a first housing configured to accommodate at least a portion of an inner barrel through which a bullet is discharged;

a second housing configured to accommodate at least a portion of a chamber coupled to one end of the inner barrel, wherein the second housing is further configured to be coupled to the first housing; and a fixing member disposed in a bore of the first housing configured to fix the first housing to the inner barrel, wherein the second housing includes a height adjustment member configured to adjust the height of the second housing such that the second housing is supported by a middle frame of the toy gun thereby restricting vertical movement of the non-tilting outer barrel in relation to the inner barrel and the middle frame, wherein the vertical movement is perpendicular to a central axis of the bore of the first housing, wherein a first screw thread is formed on an outer circumferential surface of a first portion of the first housing at which the first housing is coupled to the second housing, and wherein a second screw thread, which is coupled with the first screw thread, is formed on an inner circumferential surface of a second portion of the second housing at which the second housing is coupled to the first housing.

9. The non-tilting outer barrel of claim 8, wherein the fixing member is formed of an elastic member.

10. The non-tilting outer barrel of claim 9, wherein the fixing member is an O-ring.

11. The non-tilting outer barrel of claim 10, wherein an annular concave portion configured to hold the fixing member is formed in the bore of the first housing, wherein an outer circumferential surface of the fixing member is inserted into the annular concave portion, and wherein an inner circumferential surface of the fixing member contacts the inner barrel.

12. The non-tilting outer barrel of claim 8, wherein a third screw thread for mounting a muzzle device is formed on an inner circumferential surface of a third portion of the first housing, and wherein the first portion is disposed on one end of the first housing and the third portion is disposed on an opposite end of the first housing.

13. The non-tilting outer barrel of claim 8, wherein the second housing includes a groove having a groove depth greater than a groove height, and wherein the height adjustment member is configured to adjust the groove height in order to adjust the height of the second housing.

* * * * *